United States Patent [19]

Poloni

[11] Patent Number: 5,060,499

[45] Date of Patent: Oct. 29, 1991

[54] ROLLING STAND WITH MULTIPLE ROLLS SUPPORTED AS CANTILEVERS FOR HIGH-SPEED ROLLING

[75] Inventor: Alfredo Poloni, Fogliano Di Redipuglia, Italy

[73] Assignee: Danieli & C. Officine Meccaniche SpA, Buttrio, Italy

[21] Appl. No.: 545,630

[22] Filed: Jun. 28, 1990

[30] Foreign Application Priority Data

Jul. 10, 1989 [IT] Italy ..... 83453 A/89

[51] Int. Cl.[5] ..... B21B 45/02

[52] U.S. Cl. ..... 72/201; 72/203; 72/235; 72/249; 148/12 B

[58] Field of Search ..... 72/201, 235, 202, 200, 72/203, 249; 148/12 B

[56] References Cited

U.S. PATENT DOCUMENTS

| | | | |
|---|---|---|---|
| 4,527,408 | 7/1985 | Jalil | 72/201 |
| 4,569,023 | 2/1986 | Wakamiya | 72/201 |
| 4,625,532 | 12/1986 | Economopoulos et al. | 72/201 |
| 4,889,567 | 12/1987 | Fujiwara et al. | 148/12 B |
| 4,909,058 | 3/1990 | Bindernagel et al. | 148/12 B |

FOREIGN PATENT DOCUMENTS

| | | |
|---|---|---|
| 0264868 | 10/1987 | European Pat. Off. . |
| 3039101 | 10/1980 | Fed. Rep. of Germany . |
| 2196207 | 3/1974 | France . |
| 2234051 | 1/1975 | France . |
| 0183412 | 8/1986 | Japan . |
| 2048737 | 12/1980 | United Kingdom . |

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

Rolling stand with multiple rolls supported as cantilevers for high-speed rolling, which comprises a motor unit (16-15) that actuates at least one common shaft (22*a*) which transmits motion to a plurality of pairs of rolls (11–12) with their axes placed alternately substantially at a right angle to each other (11*a*, 12*a*, 11*b*, 12*b* . . . 11*n*, 12*n*), the stand including from six to ten pairs of rolls (11–12), the rolled stock being kept under traction between one pair of rolls (11–12) and the next pair (11–12), cooling chamber means (13) followed by temperature equalization chamber means (14) being included between the pair of rolls (12) which processes round sections and the pair of rolls (11) which processes oval sections, the length of the cooling chamber means (13) being at least a function of the rolling speed of the pair of rolls (12) positioned upstream of that cooling chamber means (13), the cooling chamber means (13) being progressively longer in the direction of feed of the rolled stock.

13 Claims, 2 Drawing Sheets

ROLLING STAND WITH MULTIPLE ROLLS SUPPORTED AS CANTILEVERS FOR HIGH-SPEED ROLLING

The invention concerns a rolling stand with multiple rolls supported as cantilevers for high-speed rolling. By high-speed rolling is meant here a rolling speed of 120 to 140 meters per second or more with sections having a diameter of 5.5 to 6.5/7 mm or equivalent.

The rolling stands with which the invention is concerned are known commercially as "high-speed blocks" and comprise a plurality of pairs of rolls supported as cantilevers, the pairs having their axes rotated alternately by 90° to each other so as to process an oval section, round section, oval section, round section and so on.

The stands according to the invention include from six to ten alternated pairs of rolls supported as cantilevers.

These stands comprise a source producing motion and one or two transmission shafts which transmit the motion to all the pairs of rolls.

One shaft advantageously transmits motion to the pairs of rolls having, for instance, a horizontal axis, while another shaft transmits motion to the pairs of rolls having, for instance, a vertical axis.

The reduction ratio as between one pair of rolls and the next is preset, so that the speed of rotation of the two pairs keeps the rolled stock under slight traction between the pairs.

The present applicant is not aware of rolling stands of the above type which are suitable to process rolled stock, normally round with sections having a diameter of 5.5 to 6.5/7 mm or equivalent shapes, at a speed of more than 120 meters per second and advantageously 140 meters per second or more.

The present applicant has found that when working under the above conditions, for instance on a stand having ten alternated pairs of rolls supported as cantilevers, a considerable increase of temperature takes place in the rolled stock, and it is therefore impossible, in fact, to reach high speeds in the present high-speed blocks.

The present invention enables the speeds cited above to be reached with the high-speed blocks processing the relative sections.

The rolling stand with multiple rolls supported as cantilevers for high-speed rolling according to the invention is set forth and characterized in the main claim, while the dependent claims describe variants of the idea of the solution.

According to the invention a fast-cooling chamber is located immediately after the pair of rolls which processes round sections and after each pair of intermediate rolls which processes round sections.

The present applicant has found that after such cooling chamber it is advantageous to place a temperature equalisation chamber so as to prevent the rolled stock arriving at the first pair of rolls (that processes oval sections) with its surface layer too cold and its core hot.

The present applicant has also found that the length of the cooling chamber and the length of the temperature equalisation chamber are correlated respectively with the speed of departure of the rolled stock from the pair of rolls which processes round sections.

Moreover, the present applicant has found that the lengths of the above two chambers become progressively greater.

According to the investigations and experiments carried out by the present applicant in a case of a variant with the purpose of reducing the dimensions of the high-speed block—dimensions which depend also on the diameter of the common transmission shaft or shafts—and with a view to enhancing the versatility of the high-speed block, the invention provides for the inclusion of an additional motor unit downstream of the first pair of rolls, thus creating a first section and a second section in the high-speed block itself.

This additional motor unit drives the first two, four or six pairs of rolls, the common transmission shaft or shafts of which remain connected to the like transmission shaft or shafts of the remaining pairs of rolls.

According to a variant the mechanical connection between the two sections of the high-speed block includes a disconnectible joint which enables the pairs of rolls of the first section and/or of the second section to be employed independently and on their own.

The present applicant has also found that, when rolling given alloys or superalloys, and in particular given types of steel, the leading end of the rolled stock tends to bifurcate and creates great problems of lead-in after the fourth pair of rolls.

The invention therefore arranges, as a variant, that after the fourth pair of rolls, which processes a round section, and before the fifth pair of rolls, which processes an oval section, a flying shears is fitted which is able to shear the leading end of the rolled product passing through and discharge that end.

The invention arranges equally well that the shears should be located near to the outlet of the round pass or to the inlet of the oval pass.

The attached figures, which are given as a non-restrictive example, show the following:

Figure 1:
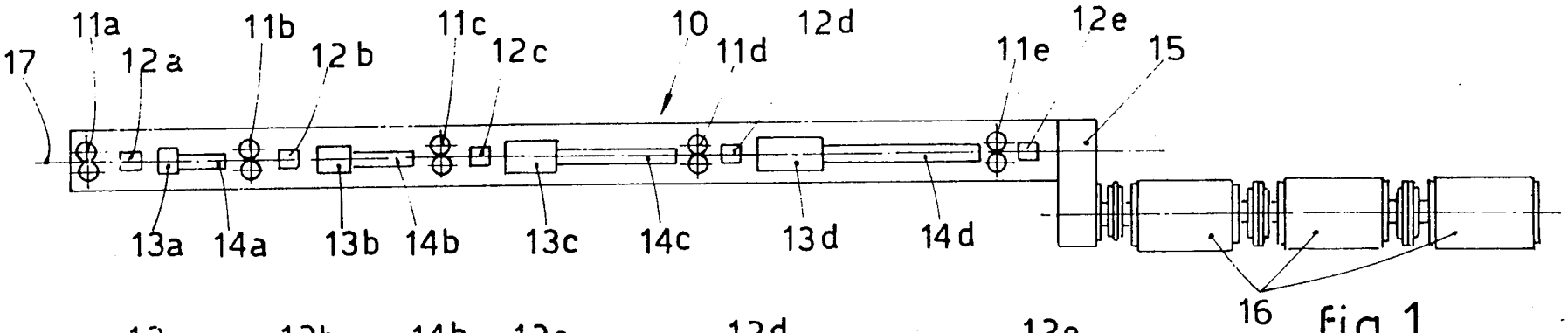
FIG. 1 shows a diagram of a high-speed block according to the invention.

In the figures a high-speed block 10 comprises, as an example, one or more motors 16 which transmit motion through a gearbox 15 to a first gearwheel 24 that actuates a second gearwheel 23, which in turn sets in rotation two common shafts 22*a*.

The common shafts 22*a* run along the whole high-speed block 10 and transmit motion to units 26 which power, support and position pairs of rolls 11 and 12.

The pairs of rolls 11 and 12 have a progressively greater peripheral speed of rotation, so that the last pair 11*e* rotates at the maximum speed of rotation of about 120 to 140 meters per second or more when processing sections having a diameter of 5.5 to 6.5/7 mm or equivalent.

In the example shown the pairs of rolls 11 serve to roll oval sections, whereas the pairs of rolls 12 serve to roll round sections.

The example shown provides for ten pairs of alternated rolls 11 and 12 supported as cantilevers. The rolling axis is referenced with 17.

The mechanical design embodiments shown are equally suitable; those shown are given only as examples.

According to the invention a first cooling chamber 13 and a second temperature equalisation chamber 14 are located in strict coordination between a pair of rolls 12 that processes round sections and a pair of rolls 11 that processes oval sections and downstream of each intermediate pair of rolls 12.

The length of the cooling chambers 13 and of the temperature equalisation chambers 14 are a function of the speed of departure of the rolled stock from the pairs of rolls 12 that processes round sections and, in the case of the temperature equalisation chambers 14, are a function also of the gradient of cooling applied to the rolled stock in the cooling chambers 13.

Figure 2:
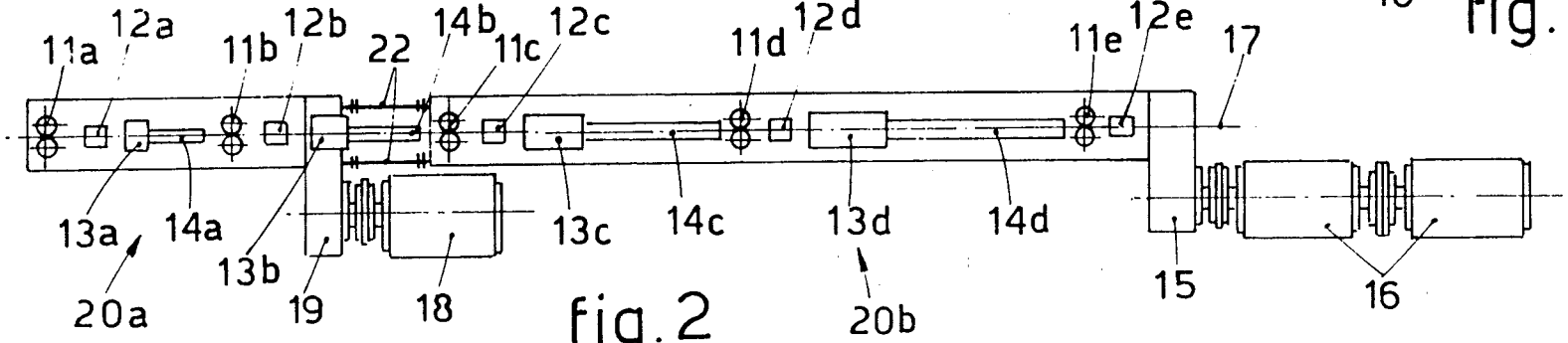
FIG. 2 shows a diagram of a high-speed block divided into two sections according to the invention.

According to the variant of FIG. 2 an auxiliary motor 18 is included downstream of the fourth pair of rolls 12*b* and governs the first four pairs of rolls 11*a*-12*a*-11*b*-12*b* by means of a gearbox 19.

Respective common shafts 22*a* of two sections 20*a* and 20*b* of the high-speed block 10 do not entail any mechanical discontinuity owing to the inclusion of shafts 22 which connect the two sections rigidly.

Joint 25 may be fitted on the shaft 22 and may be disconnected so as to disconnect the section 20*a* from the section 20*b* and to make these sections momentarily independent.

Whether the gearboxes 15 and 19 are positioned at the head or tail of the sections will depend on the design.

Figure 3:
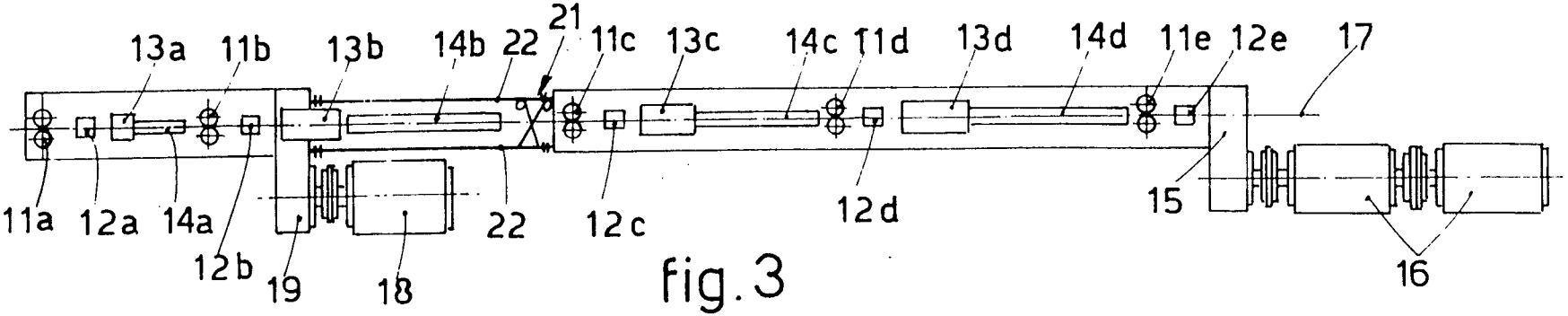
FIG. 3 shows a diagram of a high-speed block divided into two sections according to the invention, an intermediate flying shears being included.
Figure 4:
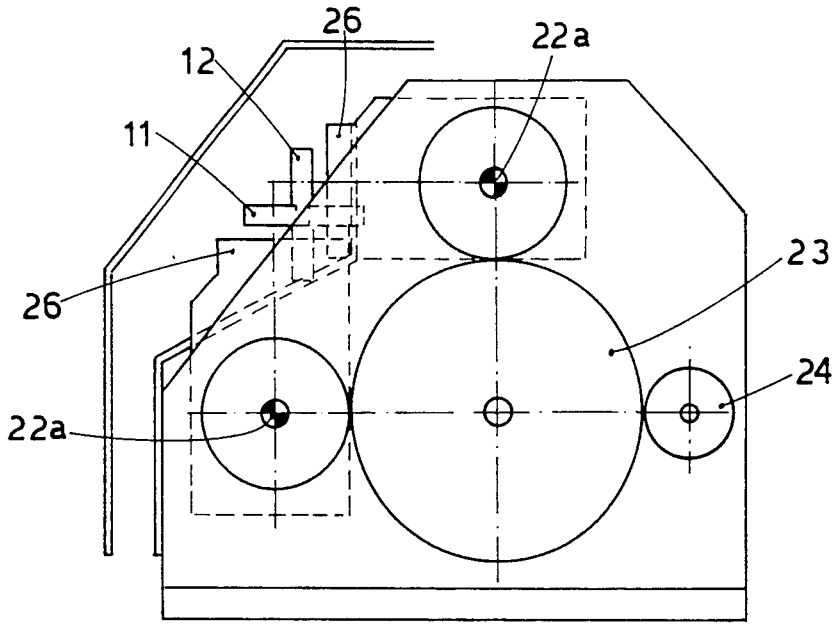
FIG. 4 shows a diagram of a normal vertical section of a high-speed block.
Figure 5:
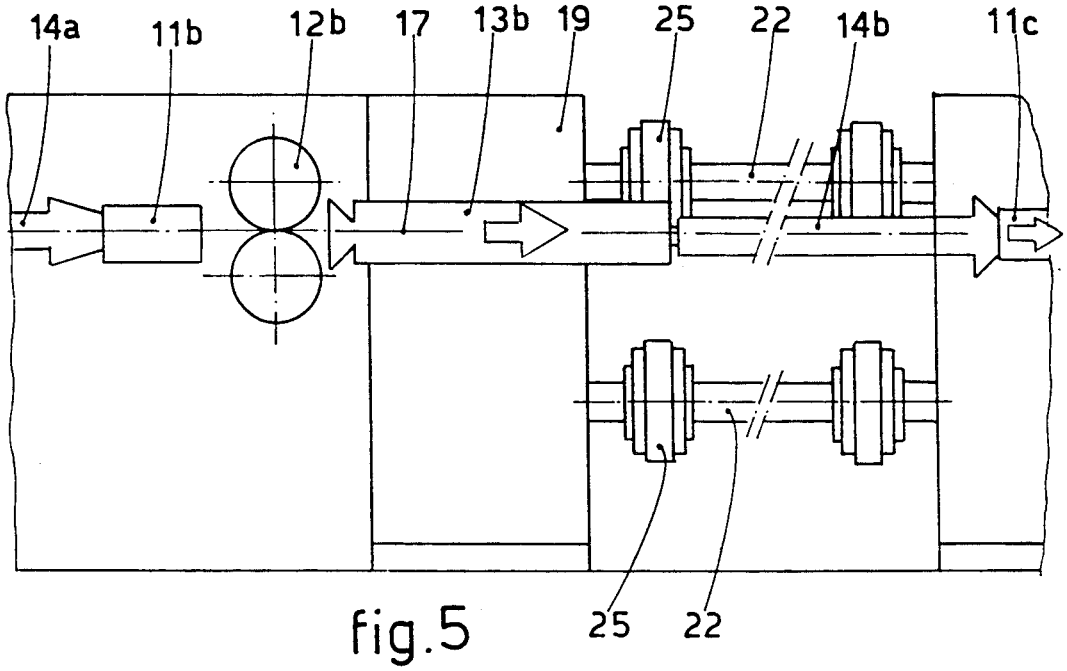
FIG. 5 shows a diagrammatic front view of a high-speed block according to the invention in the zone of connection of the first and second sections.

According to the variant of FIG. 3 a flying shears 21 suitable to shear the leading end of the rolled stock travelling through is located between the fourth pair of rolls 12*b* and fifth pair of rolls 11*c*.

It is obvious that no physical lack of continuity can exist between the cooling chamber 13 and temperature equalisation chamber 14. Moreover, the temperature equalisation chamber 14 may also possess a cooling function, even though very modest or having a value which can be varied along the length of the chamber 14.

I claim:

1. Rolling stand with multiple rolls supported as cantilevers for high-speed rolling, which comprises a motor unit that actuates at least one common shaft which transmits motion to a plurality of pairs of rolls with their axes placed alternately substantially at a right angle to each other, the stand including from six to ten pairs of rolls, a rolled stock being kept under traction between one pair of rolls and the next pair, the stand being characterized in that cooling chamber means followed by temperature equalisation chamber means are included between a pair of rolls which processes round sections and a pair of rolls which processes oval sections, the length of the cooling chamber means being at least a function of the rolling speed of the pair of rolls pair of rolls, the cooling chamber means being progressively longer in the direction of feed of the rolled stock.

2. Stand as claimed in claim 1, in which the length of the temperature equalisation chamber means is at least a function of the rolling speed of the pair of rolls positioned upstream of that chamber means (14) and a function of the gradient of cooling imparted to the rolled stock by the cooling chamber means positioned upstream of the temperature equalisation chamber means.

3. Stand as claimed in claim 1 which is divided into two in-line sections with independent drive means, the respective common shafts of the two sections being connected mechanically and rigidly by a further shaft.

4. Stand as claimed in claim 3, in which the further shaft providing mechanical connection of the respective common shafts of the two sections comprises joint means which can be momentarily disconnected.

5. Stand as claimed in claim 7 in which a flying shears to shear at least the leading end of the rolled stock travelling through is included downstream of the second pair of rolls that processes round sections and between a pair of rolls that processes round sections and the next pair of roll that processes oval sections.

6. A rolling stand for high-speed rolling of sections along a rolling axis, comprising:

at least six pairs of rolls supported as cantilevers and spaced along said rolling axis, said pairs of rolls being provided in sets of two pairs of rolls, a first pair of each set of two pairs of rolls having an axis in a first direction and a second pair of each set of two pairs of rolls having an axis in a second direction substantially perpendicular to said first direction;

at least one common shaft for transmitting motion to at least one pair of of rolls in each of a plurality of said sets;

a motor for actuating said common shaft;

means for transmitting motion from said at least one common shaft to said pairs of rolls in such a manner that said pairs of rolls are given, along said rolling axis, a progressively greater peripheral speed of rotation, whereby traction is exerted on said section between said pairs of rolls; and a plurality of cooling chambers each followed by a temperature equalization chamber provided between said sets of two pairs of rolls, said plurality of cooling chambers, having, along said rolling axis, a progressively greater length.

7. A rolling stand according to claim 6, wherein two common shafts are provided, one of said common shafts being operably connected to said pairs of rolls having an axis in said first direction, and the other of said common shafts being operably connected to said pairs of rolls having an axis in said second direction.

8. A rolling stand according to claim 6, wherein from 6 to 10 pairs of rolls are provided.

9. A rolling stand according to claim 6, wherein said one of said first and second directions is the horizontal direction and wherein the other of said first and second directions is the vertical direction.

10. A rolling stand according to claim 6, wherein said temperature equalization chambers have, along said rolling axis, a progressively greater length.

11. A rolling stand according to claim 6, wherein said rolling stand is divided into two in-line sections, each containing a plurality of sets of two pairs of rolls separated by a cooling chamber and temperature equalization chamber and each having independently at least one common shaft, a motor and means for transmitting motion from said at least one common shaft to said pairs of rolls, said two in-line sections being connected mechanically and rigidly by at least one further shaft.

12. A rolling stand according to claim 11, in which the at least one further shaft which provides mechanical connection of the respectively common shafts of the two in-line sections comprises joint means which can be momentarily disconnected.

13. A rolling stand according to claim 6, further comprising a flying shears to shear at least the leading end of said section including between a second and third of said sets of two pairs of rolls.

* * * * *